US009433983B2

(12) United States Patent
Benedetti et al.

(10) Patent No.: US 9,433,983 B2
(45) Date of Patent: Sep. 6, 2016

(54) ROLLING METHOD FOR STRIP AND CORRESPONDING ROLLING LINE

(75) Inventors: Gianpietro Benedetti, Buttrio (IT); Paolo Bobig, San Canzian d'Isonzo (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 465 days.

(21) Appl. No.: 13/981,536

(22) PCT Filed: Jan. 19, 2012

(86) PCT No.: PCT/IB2012/000073

§ 371 (c)(1),
(2), (4) Date: Oct. 8, 2013

(87) PCT Pub. No.: WO2012/101492

PCT Pub. Date: Aug. 2, 2012

(65) Prior Publication Data

US 2014/0026631 A1 Jan. 30, 2014

(30) Foreign Application Priority Data

Jan. 24, 2011 (IT) ..... UD2011A0008

(51) Int. Cl.
*C21D 8/00* (2006.01)
*B21B 1/02* (2006.01)
(Continued)

(52) U.S. Cl.
CPC ..... *B21B 1/026* (2013.01); *B21B 1/463* (2013.01); *B21B 13/22* (2013.01); *B21B 1/26* (2013.01);
(Continued)

(58) Field of Classification Search
CPC ..... B21B 1/06; B21B 1/14; B21B 1/26; B21B 1/32; B21B 1/34; B21B 1/463; B21B 13/22; B21B 15/005; B21B 45/004; B21B 2015/0057; B21B 2015/0064; B21B 1/02; B21B 2015/006; B21B 1/026
USPC ..... 72/201
See application file for complete search history.

(56) References Cited

U.S. PATENT DOCUMENTS 5,647,236 A 7/1997 Tippins
5,706,690 A 1/1998 Connolly
(Continued)

FOREIGN PATENT DOCUMENTS

CN 101336307 A 12/2008
DE 102005052774 6/2006
(Continued)

OTHER PUBLICATIONS

International Search Report and Written Opinion from PCT/IB2012/000151 mailed May 16, 2012.
(Continued)

*Primary Examiner* — David B Jones
(74) *Attorney, Agent, or Firm* — Calfee, Halter & Griswold LLP

(57) ABSTRACT

Rolling method for the production of flat products with low productivity, comprising a continuous casting step at a speed comprised between 3.5 m/min and 6 m/min of a thin slab with a thickness comprised between 25 mm and 50 mm, a roughing step to reduce the thickness in at least one forming stand or roughing stand, to a value comprised between 10 mm and 40 mm, preferably between 10 mm and 30 mm, even more preferably between 10 mm and 20 mm and suitable for winding, a rapid heating step using induction in order to at least restore the temperature lost in the segment downstream of casting and in the roughing step, a winding/unwinding step in a winding/unwinding device with two mandrels, a rolling step in a Steckel type rolling unit with two reversing type stands of the product unwound by the winding/unwinding device comprising not more than three double rolling passes, or two inversions, in order to obtain a final product comprised between 1-1.2 mm and 16 mm, a cooling step and a winding step of the final product.

21 Claims, 1 Drawing Sheet

(51) Int. Cl.

| | |
|---|---|
| ***B21B 1/46*** | (2006.01) |
| ***B21B 13/22*** | (2006.01) |
| *B21B 1/26* | (2006.01) |
| *B21B 15/00* | (2006.01) |
| *B21B 45/00* | (2006.01) |

(52) U.S. Cl.
CPC ..... *B21B 15/005* (2013.01); *B21B 45/004* (2013.01); *B21B 2015/0057* (2013.01); *B21B 2015/0064* (2013.01)

(56) References Cited

U.S. PATENT DOCUMENTS

| | | | | |
|---|---|---|---|---|
| 6,182,490 | B1 * | 2/2001 | Ginzburg | B21B 1/34 72/200 |
| 6,264,767 | B1 * | 7/2001 | Frank | B21B 1/34 148/547 |
| 7,121,130 | B2 * | 10/2006 | Kirstein | B21B 15/0007 72/148 |
| 7,363,792 | B2 * | 4/2008 | Modrow | B21B 1/466 72/201 |
| 9,126,246 | B2 * | 9/2015 | Benedetti | B21B 1/466 |

FOREIGN PATENT DOCUMENTS

| | | | |
|---|---|---|---|
| EP | 0576890 | B1 | 4/1996 |
| EP | 0937512 | | 8/1999 |
| JP | 59191502 | | 10/1984 |
| JP | 11207403 | A | 8/1999 |
| WO | 0010741 | | 3/2000 |
| WO | 2010115698 | | 10/2010 |
| WO | 2011080300 | | 7/2011 |
| WO | 2011080300 | A1 | 7/2011 |

OTHER PUBLICATIONS

Office Action from U.S. Appl. No. 13/983,407 dated Jul. 14, 2015.
Office Action from Chinese Patent Application No. 201280014721.7 dated Jun. 18, 2015.
International Search Report and Written Opinion from PCT/IB2012/000073 mailed Mar. 30, 2012.
International Preliminary Report on Patentability for PCT/IB2012/000073 mailed Jan. 15, 2013.
Third Party Observation for European Application No. 20120705405 dated Feb. 24, 2014.
Response to Office Action from U.S. Appl. No. 13/983,407 dated Oct. 14, 2015.
Notice of Opposition from Patent No. EP266798 dated Aug. 19, 2015 (German only).

* cited by examiner

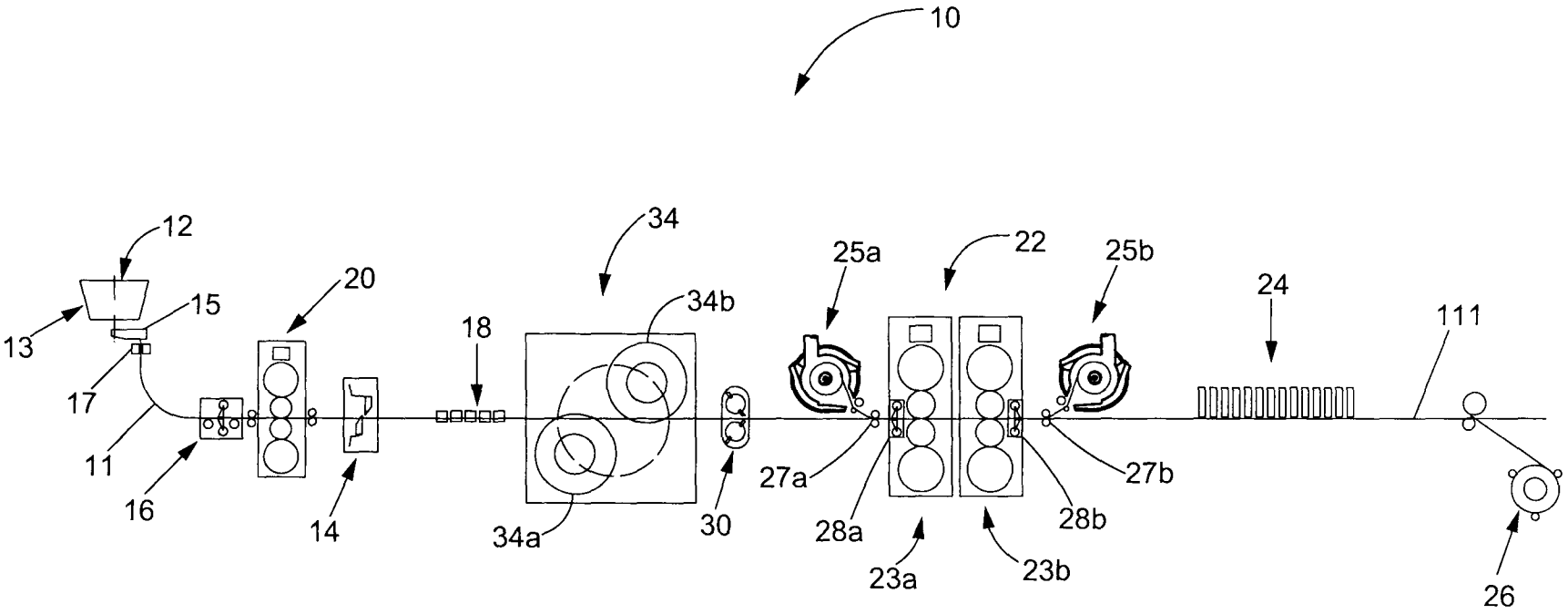
10
12
13
15
17
11
16
20
14
18
34
34a
34b
30
25a
27a
28a
22
23a
23b
28b
25b
27b
24
111
26

ROLLING METHOD FOR STRIP AND CORRESPONDING ROLLING LINE

CROSS-REFERENCE TO RELATED APPLICATION

This application is the U.S. national phase entry of PCT/IB2012/000073, with an international filing date of 19 Jan. 2012, which claims the benefit of Italian Application Serial No. UD2011A000008, with a filing date of 24 Jan. 2011, the entire disclosures of which are fully incorporated herein by reference.

FIELD OF THE INVENTION

The present invention concerns a rolling method and the corresponding line, to obtain flat metal products such as strip, in particular a low productivity method and line.

BACKGROUND OF THE INVENTION

Rolling plants are known, with a Steckel reversing rolling train with one or more stands, which use a slab with a thickness from 150 to 250 mm or more, and work in coil-to-coil mode, that is, with a slab length that in relation to the thickness is equal in weight to a coil of finished product. In such plants there is a limited surface and dimensional quality of the strip and a limited final thickness, which in general is never less than 1.8-1.6 mm, and in any case such thicknesses are obtained only with great difficulty: the surface quality is limited by the considerable scale that forms during the high number of inversions and passes through the stand/stands, and the connected down times, and by the scale which remains impressed on the final product; the dimensional quality is limited by the great difference in temperature between the leading/tail end and the central part of the strip, and the minimum final thickness is limited by the great thickness of the slab at inlet.

Furthermore, the reversing Steckel mill creates a problem connected to the fact that, in the first rolling passes, the roughed slab (or transfer bar or simply bar) cannot normally be wound immediately in the reel furnaces disposed upstream and downstream of the stand, due to the great thickness of the entering slab, which creates a problem of bulk in the line as the length of the slab increases.

Moreover, the high number of rolling passes, with consequent winding and unwinding in the reel furnaces located upstream and downstream of the stand/stands, induces cooling of the leading and tail ends, and also a lack of uniformity of temperature along the coil, which penalizes the yield due to the need to crop the leading and tail ends.

This large number of passes also causes variable dimensional tolerances along the length of the finished strip and limitations in the production of thin thicknesses; it also causes rapid wear of the work rolls due to the large number of passes and the low temperature of the material being worked and of the leading and tail ends, with a consequent increase in stoppages to change the rolls and therefore a lesser use of the plant.

The entrance of the cold and deformed leading ends into the furnaces upstream and downstream of the stand/stands remains a delicate operation, with risks of jamming that become more and more probable as the thickness of the strip decreases.

WO-A-00/10741 describes a rolling method that, in one form of embodiment, provides a continuous casting step, a roughing step, directly downstream of casting, a heating step carried out after roughing and upstream of a finishing rolling step. In another alternative form of embodiment of WO'741, between the roughing step and the heating step a winding/unwinding step is provided. In another alternative form of embodiment of WO'741, the heating step is the rapid type and is provided directly downstream of casting, whereas the roughing step is provided after the rapid heating, very distant from casting. After the roughing step a winding/unwinding step is provided, after a possible further heating step, which makes the method and connected rolling line according to WO'741 more expensive and dimensionally bigger, and finally the finishing rolling, after which there may follow a possible final pass in the rolling stands (skin pass), to try to obtain the desired final thicknesses.

WO-A-2010/115698 describes a rolling method that only provides a continuous casting step, a roughing step, a rapid heating step after roughing, a step of detecting scale, a pre-cooling step, a de-scaling step and finally a finishing rolling step.

JP-A-59191502 describes a rolling unit provided with a single Steckel type rolling stand, equipped with induction type heating means disposed between the rolls of the rolling stand and the reel furnaces at entrance to and exit from the rolling stand.

The main purpose of the present invention is to obtain a rolling method for flat products and a corresponding line, which can guarantee a final product of high quality in terms of reduced scale impressed, good surface quality and dimensional tolerance even along the length.

Another connected purpose is to obtain an extremely compact plant, having low investment costs and an annual productivity limited from 300,000 to 800,000 tons, which allows to obtain thin strip with a thickness of as little as 1.2 mm or less.

Another purpose of the present invention is to perfect a method that allows to reduce to a minimum the number of rolling passes and inversions, and hence to reduce the total rolling time, with consequent greater uniformity/homogeneity of temperature along the strip being rolled and a lesser overall loss of temperature of the strip.

Another purpose is to increase the factor of use of the plant, increasing the operating duration of the work rolls.

Furthermore, another purpose of the present invention is to exploit to the utmost the high plasticity of the steel at the high temperatures that it possesses when it has just solidified, to carry out the roughing rolling of the product exiting from the continuous casting machine, so that it is thus possible to use smaller stands and hence with a lower power installed and considerable energy saving.

Another purpose is to obtain a continuous casting and rolling method without intermediate storage and recovery of material, and therefore lower heating energy.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe variants to the main inventive idea.

In order to obtain all the purposes and advantages set forth above and listed hereafter, the invention provides to feed a reversing two-high Steckel rolling train with a very thin slab, having a thickness that can be modulated downstream of casting, so that it is always possible to obtain the final product with at most three double rolling passes (two inversions).

This means reducing to the lowest value possible the number of rolling passes and inversions (and hence the total rolling time and inversion downtimes), reducing to a minimum the time that the product being rolled is exposed to air and hence the formation of scale and impression of scale on the surface of the strip. Furthermore, a better temperature homogeneity/uniformity is obtained along the strip, with a lower drop in temperature overall, a reduction in the number of times that the cold leading/tail ends pass under the work rolls with lower wear thereof and hence better dimensional and surface quality of the final strip, together with the possibility of producing very thin thicknesses, as little as about 1.2 mm or less.

According to the present invention, a rolling method for the production of flat products with low productivity comprises a continuous casting step at a speed comprised between 3.5 m/min and 6 m/min of a thin slab, with a thickness comprised between 25 and 50 mm, advantageously between 30 and 40 mm, a roughing step to reduce the thickness in at least one roughing stand to a value comprised between 10 mm and 40 mm, preferably between 10 mm and 30 mm, even more preferably between 10 mm and 20 mm and suitable for winding, a rapid heating step using induction in order to at least restore the temperature lost in the segment downstream of casting and in the roughing step, a winding/unwinding step in a winding/unwinding device with two mandrels, which is carried out after the rapid heating step, a rolling step of the reversing type of the product unwound by the winding/unwinding device comprising not more than three double rolling passes (two inversions) in order to obtain a final product comprised between 1-1.2 mm and 16 mm, a laminar cooling step using water and a winding step of the final product.

The present invention allows to exploit the high temperature of the cast material directly as it comes out of the casting step for the roughing step carried out directly and immediately downstream of casting, with consequent energy saving.

Furthermore, providing a single rapid heating step reduces energy consumption and makes the line more compact.

Hereafter, the pre-rolled product exiting from the roughing stand downstream of casting will simply be called "bar".

In one form of embodiment of the method according to the present invention, the second Steckel stand, meaning the one located most downstream in the direction of first advance of the product, advantageously has very limited reduction percentages, or does not intervene, or at most intervenes with small pressures in the rolling, so as to keep the rolling rolls at temperature, in at least one of the two first double passes, in order to reduce wear on the rolls and hence to optimize the surface quality in the finishing operation carried out in the third double pass. This functioning mode of the second Steckel stand also allows to increase the operating life of the finishing rolls and hence to reduce, and indeed almost halve, the stoppages of the rolling mill due to changes of the finishing rolls, with a consequent improvement in the factor of use of the plant, which becomes comparable to that of a casting and rolling plant with a continuous train in endless mode. The roll change can advantageously be carried out concurrent with the stoppage of the casting machine to change its configuration, or restranding.

In another form of embodiment of the method according to the present invention, for thicknesses of the final strip of more than 5-6 mm, the rolling in the Steckel reversing train advantageously takes place without inversions, and therefore the time the product is exposed to air, and also the formation of scale, is drastically reduced.

In variants of the method, the forming stand performs an adaptive reduction in thickness comprised between 20 and 60%, advantageously between 35 and 55%, and advantageously feeds the rolling step with a variable thickness of the thin slab at least as a function of the following parameters: thickness of strip, width of strip, type of steel, or steel grade.

The forming stand exploits the high temperature at exit from casting and the lower resistance of the material due to the lack of "re-crystallization", it allows to use smaller stands which require less power installed, and hence the costs, intrinsic and of installation, of the roughing stand are lower.

In some forms of embodiment of the method, the winding/unwinding device which functions as at least a temperature maintenance furnace is heated, so that during the winding/unwinding steps the slab remains at a temperature suitable for the subsequent rolling, also reducing costs and bulk compared with a traditional tunnel furnace. In other variants, the winding/unwinding device can also function as a store to allow the roll change, since the time for winding the bar onto the mandrel of the winding/unwinding device is coherent with the roll change time in the stands of the reversing rolling mill.

As we said above, the final product is obtained by making at most three double rolling passes, or two inversions, therefore the line produces with good quality because the time that the product is exposed to the air, and therefore also the formation of scale, is reduced to a minimum. The reduction of scale can be further increased with de-scalers, for example using water at ultra-high pressure, which clean the finished strip in the winding steps.

Furthermore, the rolling method described above reduces the temperature difference between the ends and the center of the segments of slab, obtaining a product with a better dimensional tolerance, reaching final thicknesses of as little as 1-1.2 mm.

The method, according to some forms of embodiment, is also able to carry out a dynamic reduction of the thickness of the cast slab with liquid core, or so-called dynamic soft reduction, downstream of the crystallizer, in order to obtain a better metallurgic structure. The thickness obtained after dynamic soft reduction is comprised between 25 mm and 50 mm If there is no soft-reduction unit present, it is the crystallizer itself that directly supplies the final thickness of the slab.

The method according to the present invention focuses on low productivity, deliberately sought in order to satisfy particular requirements of local markets and hence to save on investment costs, while at the same time maintaining high quality of the product. The plant adopting the method allows to operate in sequence with electric furnaces, or with other production devices for liquid steel, at a rhythm of from 40 to 140/150 tons/hour.

Since we have a low casting speed and a small thickness of the product cast, the mass flow, which is given precisely by the product of the casting speed and casting thickness, is consequently low and does not allow to have temperatures suitable for rolling downstream: the inductor furnace and the heated winding/unwinding device are advantageous because they respectively allow to restore the temperature and to keep it at the value required for the subsequent rolling process.

It is advantageous to use the winding/unwinding device, which combines well with the low productivity and reduced mass-flow of the casting, since it allows to avoid using very long tunnel furnaces able to contain a thin slab with a length equivalent to a roll of finished strip weighing 25-30 tons. Furthermore, with the winding/unwinding device, the problem of moving a very thin slab inside the tunnel furnace is solved, which would further complicate production and increase costs.

According to another feature of the method of the present invention, the bar that is fed to the Steckel mill, thanks to the suitable thickness that it already has in this step, can be wound immediately on the winding reel, so that it prevents the problem, common in the state of the art, of moving the long bar on a plane on the run-out table for two or more passes through the mill before being able to wind it on the winding reels.

The main advantage of winding the bar immediately after the first rolling pass is to reduce the overall dimensions of the plant and to reduce the time the product is exposed to air, which causes scale, and to contain the heat losses, which gives the advantage of a far lower temperature drop and a greater uniformity between the head/tail end and the central part of the bar being rolled. This has a positive effect on the dimensional and surface quality of the finished strip and also on the possibility of obtaining thin thicknesses.

The present invention also concerns a rolling line for the production of flat products with low productivity which comprises a casting machine able to continuously cast a thin slab at low speed, for example comprised between 3.5 and 6 m/min, a rapid heating unit and a rolling unit comprising two combined stands, of the reversing Steckel type. The solution with the reversing rolling unit allows to reduce the number of stands, and hence the bulk and costs of making it, compared to a continuous rolling train.

The at least one roughing stand is configured to allow an adaptive reduction in thickness comprised between 20 and 60%, advantageously between 35 and 55%, and, exploiting the high temperature at casting exit and the lower resistance of the material due to the lack of re-crystallization, allows to use smaller stands, which require less power installed, and hence to obtain a considerable energy saving.

The at least one roughing stand advantageously allows to feed the rolling unit, advantageously a two-high Steckel stand, with a variable or "modulatable" thickness of the thin slab so that the final product is obtained at most with three double rolling passes (two inversions).

Advantageously, moreover, the thinner thicknesses obtained allow to use smaller stands in the Steckel rolling unit, with lower power installed, thus further reducing costs and bulk.

One advantage of using two stands in the rolling unit is that the number of inversions is reduced, and therefore the time the product is exposed to air and consequently the formation of scale and scale impressed is also reduced, increasing the quality of the final product. Indeed, typically, the rolling time in this configuration is about 5-6 minutes. Moreover, the temperature distribution between the ends and the center of the segment of bar is more uniform, having a better dimensional quality of the final product.

According to another feature of the invention, the second Steckel stand works only if necessary and to the necessary extent, according to the thickness of the strip to be produced, and in this way the surfaces of the corresponding work rolls are preserved from wear. This allows to always obtain a good surface quality of the strip in the final finishing passes. In normal production, the second stand can also work in "kissing rolling" mode, with very limited reductions and consequent limited rolling stresses, again with the intent of limiting the wear on the work rolls.

For example, in one solution of the invention, the percentage reduction in the first stand of the two-high Steckel mill is comprised between 25 and 50%, advantageously between 30 and 45%, while the percentage reduction in the second stand of the Steckel mill is comprised between 0 and 30%, advantageously between 10 and 25%. In particular, in the two intermediate passes (that is, excluding the last one in which the final thickness is obtained) through the second stand the percentage reduction is advantageously comprised between 0 and 20%.

With this strategy, moreover, the operating duration of the work rolls is increased, and the stoppages of the rolling mill due to roll changes are reduced, with a consequent improvement in the factor of use of the plant. The use of the second Steckel stand in "kissing rolling" mode can perform a function similar to the additional skin-pass rolling stands in WO'741, but without the increase in costs and bulk of WO'741, since the present invention provides fewer rolling stands, lower investment and operating costs, less scale formation, better surface quality of the final product and a more compact layout that entails fewer costs.

According to one feature of the present invention, the rapid heating unit is an inductor furnace configured to at least recover the temperature losses deriving from the pass in the roughing stand, and downstream of the inductor furnace there is a winding/unwinding device with at least two mandrels able to selectively and alternately perform the function of winding the bar arriving from casting and to unwind it so as to feed it to the rolling unit.

The roughing stand downstream of casting not only makes the bar available to the winding/unwinding device, but also optimizes the work and the productivity of the line and supplies the rolling unit, advantageously having a two-high stand, with the ideal slab thickness to obtain the final product with at most three double passes (two inversions).

The line according to the present invention allows to have low productivity but good quality of the final product. The fact that the rolling train is fed with reduced thicknesses from casting reduces the exposure time, reducing scale on the product, and reduces the temperature difference between ends and center of the segment of bar, improving the dimensional quality. The line according to the present invention is extremely compact, with a very short layout, which requires a minimum economic investment, also considering the reduction in costs for the excavation of the foundations.

BRIEF DESCRIPTION OF THE DRAWINGS

These and other characteristics of the present invention will become apparent from the following description of a preferential form of embodiment, given as a non-restrictive example with reference to the attached drawings wherein:

FIG. 1 shows schematically a form of embodiment of a rolling line for thin slabs according to the invention.

DETAILED DESCRIPTION OF A PREFERENTIAL FORM OF EMBODIMENT

FIG. 1 shows a rolling line 10 according to the present invention for the production of rolled flat products, for example strip 111, which comprises a continuous casting machine 12 which produces in this case a thin bar 11. The machine 12 conventionally provides a ladle 13, a tundish 15 and a crystallizer 17.

In some forms of embodiment, in the curved path shown in the drawings at exit from the crystallizer 17, the slab 11 may be subjected to a dynamic soft reduction, in order to obtain a better metallurgic structure. According to the invention, the cast thickness, after soft-reduction, is comprised between 25 mm and 50 mm.

In some forms of embodiment, the thin slab cast has a width of 800-2000 mm, maximum length of 73.3 m and coil weight of 25 tons.

The rolling line 10 according to the present invention is configured overall to produce coils with a thickness of about 1-1.2-1.6 mm to about 16 mm.

Since the rolling line 10 is low productivity, the rolling process according to the present invention provides a rolling speed for the slab 11 comprised between 3.5 and 6 m/min.

After the crystallizer 17, the thin slab 11 is sent to a first shearing unit 14 by means of which the slab 11 is sheared to size.

The first shearing unit 14 is of a known type and advantageously synchronized with the casting speed.

In some forms of embodiment, the first shearing unit 14 may comprise a pendulum shear. In other forms of embodiment, the first shearing unit 14 may comprise a rotary shear or crank shear.

During the production cycle, the first shearing unit 14 shears the slab 11 into segments of a desired length, correlated to the desired weight of the coil or roll of final strip.

In particular, the length of the segments of slab is such as to obtain a coil of a desired weight, for example 25 tons, so that the rolling process is carried out in the so-called coil-to-coil mode.

Upstream of the first shearing unit 14, after casting, a de-scaler 16 may be provided. In some forms of embodiment, the de-scaler 16 is preferably of the type having rotary nozzles and performs a careful removal of the scale from the surface of the cast product, using the minimum delivery of water possible, with a modest drop in temperature of the cast product.

According to the present invention, immediately downstream of the casting machine 12 there is also a roughing stand 20.

In some forms of embodiment, a plurality of roughing stands 20 may be provided, in series. Typically, in some forms of embodiment, each roughing stand 20 is a four-high stand.

According to the present invention, the working diameter of the rolls of the roughing stand 20 is comprised between 550 mm and 650 mm, preferably between 575 mm and 625 mm, for example about 600 mm. The length of the rolls is about 1500-1800 mm, for example about 1750 when the diameter is 600 mm.

Moreover, in some forms of embodiment the separation force of the roughing stand 20 is about 3000 tons (30000 kN).

Furthermore, in some forms of embodiment the nominal power of the motor of the roughing stand 20 is 1500 kW.

The function of the roughing stand 20 is to adaptively reduce the thickness of the slab 11 with its solidified core, still very hot, immediately at exit from the casting machine 12. According to the present invention, adaptive reductions of less than about 60% are obtained, for example comprised between about 20% and about 60%, advantageously between about 35% and about 55% of the initial thickness. In some forms of embodiment, the roughing stand 20 reduces the thickness of the slab 11 to about 10 mm and 40 mm, preferably between 10 mm and 30 mm, still more preferably between 10 mm and 20 mm.

According to the present invention, downstream of the first shearing unit 14 and the roughing stand 20 along the rolling line 10, a rapid heating unit is disposed, in this case an inductor furnace 18, to carry out a rapid heating step and configured to at least recover the temperature losses deriving from the pass in the roughing stand 20, advantageously with the function of homogenizing and heating the cast product.

In this case the roughing stand 20 is disposed downstream of the casting machine 12, between the first shearing unit 14 and the inductor furnace 18.

The main advantage of this disposition of the roughing stand 20 is that the adaptive reduction of the thickness is carried out when the slab 11 still has a hot core, which requires a smaller stand and hence a lower power installed with consequent energy saving.

In some modes of use of the invention, such as for example the production of some steel grades particularly sensitive to cracks, the roughing stand 20, or more than one if provided, may remain open, and therefore without achieving any reduction in the thickness of the slab 11.

Downstream of the inductor furnace 18, the rolling line 10 provides a winding/unwinding device 34 with at least two mandrels 34*a*, 34*b* to carry out a winding/unwinding step after the rapid heating step. The at least two mandrels 34*a*, 34*b* are able to perform, selectively and alternately, the function of winding the bar arriving from the casting machine 12 and to unwind it to feed it to a subsequent rolling train 22 with stands of the reversing type of which more will be said hereafter in the description. For example, the winding/unwinding device 34 can be made as in the international application PCT/EP2010/070857 in the name of the present Applicant, entirely incorporated here for reference.

In some forms of embodiment, the winding/unwinding device 34 is the heated type, to function as a furnace to at least maintain the temperature, so that during the winding/unwinding steps the bar remains at a suitable temperature for subsequent rolling in the rolling train 22, also reducing costs and bulk.

If the rolling mill is stopped, the winding/unwinding device 34 allows to accumulate at most two segments of bar inside it without stopping the casting machine 12, hence functioning as a store, and then introduces them again into the rolling line 10 when the rolling train 22 starts up again. In this way it is possible to operate, for example, in some functioning modes of the rolling line 10, in the event of a stoppage of the rolling train 22 in an emergency (for example blockage), or programmed stoppage (for example roll change). Advantageously, the time for winding the bar onto one or more mandrels 34*a*, 34*b* of the winding/unwinding device 34 is consistent with the time of the roll change in the stands of the rolling train 22.

Immediately downstream of the winding/unwinding device 34 there is an emergency shear, or crop shear 30, of a known type.

The rolling train 22 according to the present invention is the reversing Steckel type, and in this case is a two-high stand, formed by two Steckel stands 23*a*, 23*b*, in cooperation with winding/unwinding reels 25*a*, 25*b*, in some forms of embodiment heated reels, also known as furnace reels. The winding/unwinding reels 25*a* and 25*b* cooperate with respective drawing units 27*a*, 27*b*.

In the solution shown, upstream of the first stand 23*a* and downstream of the second stand 23*b* there are respective de-scaling devices, indicated by 28*a* and 28*b* respectively, which perform the function of removing the scale before and/or after each rolling pass, preventing the scale from being impressed on the surface of the strip by the action of the rolling rolls.

The working diameter of the rolls of each Steckel stand 23*a*, 23*b* is about 530 mm, with a length of about 2050 mm.

The working diameter of the rolls of each winding/unwinding reel 25*a*, 25*b* is about 1350 mm, with a length of 2050 mm.

The rolling method according to the present invention provides not more than three double passes through the stands 23*a*, 23*b*, which determine the desired reductions in thickness.

In particular, with this solution, in the typical production of strip 111, the slab 11 is made to pass a first time through the stand 23*a* (first reduction in thickness of the first double rolling pass comprised between about 30% and 45%) and 23*b* (second reduction in thickness of the first double pass comprised between about 30% and 50%), for sequential reductions in thickness.

If strip is produced, the strip exiting from the second stand 23*b* is wound on the second winding/unwinding reel 25*b*.

Afterward, the direction of the strip is inverted, for a second rolling pass through the stands 23*b* (first reduction in thickness of the second double pass comprised between about 28% and 50%) and 23*a* (second reduction in thickness of the second double pass comprised between about 28% and 50%), to further reduce the thickness.

Finally, the direction of feed is inverted a third time for a third rolling pass through the stands 23*a* (first reduction in thickness of the third rolling pass comprised between about 24% and 39%) and 23*b* (second reduction in thickness of the third double pass comprised between about 20% and 25%) which reduce the thickness to the final value desired.

The thickness at exit from the Steckel rolling train 22 is set to an appropriate value to carry out the rolling step in the Steckel with three double passes, according to the desired final thickness of the strip 111, advantageously from about 16 mm to about 1.2 mm or even less.

Furthermore, after the rolling train 22, the rolling line 10 includes a rollerway on which the strip 111 exits, at speeds of about 1.5-12 m/sec, and a cooling unit 24. For example, the cooling unit 24 is the type with laminar shower cooling.

Downstream of the cooling unit 24 the rolling line 10 comprises a winding unit 26, for example formed by a winding reel (downcoiler) to wind the strip 111 to produce the coils of strip.

The invention claimed is:

1. A rolling method for the production of flat products with a low productivity comprising:

a) continuously casting a slab having a thickness between 25 mm and 50 mm at a speed between 3.5 m/min and 6 m/min, b) roughing the slab in at least one of a forming stand or a roughing stand to reduce the slab's thickness to between 10 mm and 40 mm, c) rapidly heating the slab downstream of said casting and roughing steps, d) winding and unwinding the slab in a winding/unwinding device having at least two mandrels after the step of rapidly heating, and e) rolling the slab in a rolling unit having two reversing stands, wherein the rolling step comprises no more than three double rolling passes or two inversions to obtain a final slab having a thickness between 1 mm and 16 mm, wherein in each of the double rolling passes, the percentage thickness reduction of the slab in the first stand is between 25% and 50% and the percentage thickness reduction of the slab in the second stand is between 0% and 30%.

2. The rolling method of claim 1, further comprising cooling the slab.

3. The rolling method of claim 2, further comprising winding the slab.

4. The rolling method of claim 1, wherein in the at least one of the two first double rolling passes in the rolling step, the first stand downstream in the direction of the first advance of the product does not intervene in the rolling.

5. The rolling method of claim 1, wherein in each of the double rolling passes in the rolling step, the percentage thickness reduction in the first stand is between 30% and 45%, and wherein the percentage thickness reduction in the second stand is between 10% and 25%.

6. The rolling method of claim 5, wherein in the two intermediate passes through the second stand in the rolling step, the percentage thickness reduction is between 0% and 20%.

7. The rolling method of claim 1, wherein the roughing step comprises the at least one of a forming stand or a roughing stand performs an adaptive reduction in thickness between 20% and 60%.

8. The rolling method of claim 1, wherein the roughing step comprises the at least one of a forming stand or a roughing stand feeds the rolling step with a variable thickness of the slab at least as a function of the following parameters: thickness of strip, width of strip, type of steel, or steel grade.

9. The rolling method of claim 1, wherein the final slab having a thickness of more than 5 mm to 6 mm, and the rolling in the rolling unit occurs without inversions.

10. The rolling method of claim 1, wherein the winding/unwinding device in the winding and unwind step functions as at least a temperature-maintenance furnace to maintain the slab at a temperature suitable for subsequent rolling.

11. The rolling method of claim 1, wherein the winding/unwinding device in the winding and unwind step functions as a store to allow the roll change, since the time for winding the slab onto the mandrel of the winding/unwinding device is coherent with the roll change time in the stands of the rolling unit.

12. The rolling method of claim 1, wherein the thickness of the slab with a liquid core is dynamically reduced after a crystallizer.

13. A rolling line for the production of flat products with low productivity adopting the rolling method of claim 1, comprising:

a continuous casting machine configured to continuously cast a slab at a speed of between 3.5 m/min and 6 m/min, at least one of a forming stand or a roughing stand connected to an exit of the continuous casting machine and upstream of the rapid heating unit, a rapid heating unit having an inductor furnace to recover the temperature lost passage through the forming stand or the roughing stand, a winding/unwinding device having at least two mandrels and configured to selectively and alternately wind the slab arriving from the continuous casting machine and unwind the slab to feed a rolling unit, and the rolling unit comprising two combined reversing stands.

14. The rolling line of claim 13 wherein said at least one of a forming stand or a roughing stand to allows an adaptive reduction in thickness of between 20% and 60%.

15. The rolling line of claim 13 wherein said at least one of a forming stand or a roughing stand feeds the rolling unit with a variable thickness of the slab at least as a function of the following parameters: thickness of strip, width of strip, type of steel, or steel grade.

16. The rolling line of claim 13 wherein said at least one of a forming stand or a roughing stand performs an adaptive reduction in thickness between 10 mm and 40 mm.

17. The rolling line of claim 13 wherein the winding/unwinding device comprises at least a temperature-maintenance furnace to maintain the slab at a temperature suitable for subsequent rolling.

18. The rolling line of claim 13 wherein the winding/unwinding device allows a roll change, as the time for winding the slab onto the mandrel of the winding/unwinding device is coherent with the roll change time in the stands of the rolling unit.

19. The rolling line of claim 13 wherein the rolling unit performs a thickness reduction of the slab to between 1.2 mm and 16 mm by means of no more than three double rolling passes through the stands of the rolling unit.

20. The rolling line of claim 13 wherein the second stand is downstream in the direction of first advance of the slab and performs the finishing of the rolled slab, and wherein during a first and/or second pass through the stands, rolls of the second stand are held at least partly open.

21. The rolling line of claim 13 wherein the continuous casting machine comprises a dynamic thickness reduction unit for the slab with a liquid core after a crystallizer.

* * * * *